US009022802B2

(12) United States Patent
Jiang

(10) Patent No.: US 9,022,802 B2
(45) Date of Patent: May 5, 2015

(54) TERMINAL MODULE

(71) Applicant: Concraft Holding Co., Ltd., Grand Cayman (KY)

(72) Inventor: Yong-Hong Jiang, Grand Cayman (KY)

(73) Assignee: Concraft Holding Co., Ltd., Grand Cayman (KY)

( * ) Notice: Subject to any disclaimer, the term of this patent is extended or adjusted under 35 U.S.C. 154(b) by 159 days.

(21) Appl. No.: 13/846,625

(22) Filed: Mar. 18, 2013

(65) Prior Publication Data

US 2014/0273643 A1 Sep. 18, 2014

(51) Int. Cl.

| | |
|---|---|
| ***H01R 13/60*** | (2006.01) |
| ***H01R 13/405*** | (2006.01) |
| ***H01R 13/506*** | (2006.01) |
| *H01R 12/72* | (2011.01) |

(52) U.S. Cl.

CPC ..... *H01R 13/405* (2013.01); *H01R 12/725* (2013.01); *H01R 13/506* (2013.01)

(58) Field of Classification Search

CPC ..... H01R 13/514; H01R 23/7073; H01R 23/6873; H01R 23/025; H01R 27/02; H01R 13/2442; H01R 11/32; H01R 12/57; G06K 7/0021

USPC ..... 439/541.5, 626

See application file for complete search history.

(56) References Cited

U.S. PATENT DOCUMENTS

| | | | | |
|---|---|---|---|---|
| 6,666,717 | B1 * | 12/2003 | Choy | 439/541.5 |
| 6,814,612 | B1 * | 11/2004 | Hu et al. | 439/541.5 |
| 7,611,387 | B1 * | 11/2009 | Zhang | 439/660 |
| 7,682,163 | B2 * | 3/2010 | Hou et al. | 439/79 |
| 7,748,999 | B1 * | 7/2010 | Sun et al. | 439/79 |
| 7,758,380 | B2 * | 7/2010 | Wang et al. | 439/607.23 |
| 7,789,706 | B2 * | 9/2010 | Chen et al. | 439/607.35 |
| 7,850,465 | B1 * | 12/2010 | Wan et al. | 439/79 |
| 7,905,747 | B2 * | 3/2011 | Suzuki et al. | 439/498 |
| 7,909,653 | B1 * | 3/2011 | Wan et al. | 439/660 |
| 7,942,704 | B2 * | 5/2011 | Ko et al. | 439/660 |
| 7,997,927 | B2 * | 8/2011 | Wan et al. | 439/541.5 |
| 8,241,063 | B2 * | 8/2012 | Nagata et al. | 439/607.01 |
| 8,292,671 | B2 * | 10/2012 | Chung | 439/660 |
| 2006/0183371 | A1 * | 8/2006 | Tsai | 439/541.5 |

* cited by examiner

*Primary Examiner* — Abdullah Riyami
*Assistant Examiner* — Vladimir Imas
(74) *Attorney, Agent, or Firm* — Rabin & Berdo, P.C.

(57) ABSTRACT

A terminal module is applied in an electrical connector having an insulating body, and includes first terminals, a first fixing bracket, second terminals, and a second fixing bracket. The first terminals and the second terminals are arranged parallel to each other along the same direction. The first fixing bracket is configured to fix the first terminals and the second fixing bracket is configured to fix the second terminals. The first fixing bracket is provided with a positioning hole extending along the arrangement direction of the first terminals. Furthermore, a positioning portion protrudes from the second fixing bracket in the direction towards the first fixing bracket, and corresponds to the positioning hole.

Therefore, the first fixing bracket and the second fixing bracket are inserted into each other through the insertion of the positioning portion into the positioning hole, and are further received in the insulating body of the electrical connector.

10 Claims, 7 Drawing Sheets

TERMINAL MODULE

BACKGROUND OF THE INVENTION

1. Technical Field

The present invention relates to a terminal module, and more particularly to a terminal module applied in an electrical connector having an insulating body.

2. Related Art

An electrical connector is mainly used for joining two different devices. More particularly, an electrical connector is an indispensable part for an electronic product. As electronic products become lighter and thinner, electrical connectors also develop along with the change of time.

In a conventional electrical connector, metal terminals are usually mounted in an insulating body in the manner of inserting pins. Mainly, relatively broad barbs are provided on the metal terminals, so that the barbs are interlocked with the insulating body, and therefore the metal terminals are fixed in the insulating body effectively.

However, in such manners, a relatively large space must be reserved in an insulating body to fix metal terminals, which makes the volume of the entire electrical connector too large, and further makes it impossible to keep an electronic product light and thin.

Consequently, an electrical connector in which metal terminals are fixed through insert molding is also commercially available. In such an electrical connector, mainly, metal terminals in different rows are fixed through insert molding respectively and then are mounted in an insulating body respectively.

However, in such a manner, plastic seats must be formed through insert molding respectively on different rows of metal terminals and then the plastic seats are mounted in an insulating body respectively. Therefore, each plastic seat must be provided with a fastening device to be fastened with the insulating body, so that the plastic seats can be fastened to the insulating body respectively. In this way, fastening devices must be designed on both the plastic seats and the insulating body. Since the space inside the insulating body is limited, when the space for two fastening devices further must be reserved in the insulating body, the volume of the electrical connector cannot be reduced and the height is also limited, making it impossible to make an electrical connector thinner and lighter.

In view of the above, how to provide a terminal module whose height can be reduced is a technical measure to be provided in the present invention.

SUMMARY

In view of the above problem, the present invention provides a terminal module, and more particularly, one that is applied in an electrical connector having an insulating body and capable of reducing the height of an electrical connector.

To achieve this objective, the terminal module of the present invention is mainly provided in an electrical connector having an insulating body. The terminal module includes a plurality of first terminals, a first fixing bracket, a plurality of second terminals, and a second fixing bracket.

The plurality of first terminals is arranged along a direction, each first terminal including a first contact portion, a first soldering portion, and a first fixing portion for connecting the first contact portion and the first soldering portion.

The first fixing bracket fixes the first terminals through insert molding, the first fixing bracket covering the first fixing portion of each first terminal, and a first positioning hole being provided on each first fixing bracket along the arrangement direction of the first terminals.

The plurality of second terminals is arranged in the same direction as the first terminals and is alternately parallel to the first terminals, each second terminal including a second contact portion, a second soldering portion, and a second fixing portion for connecting the second contact portion and the second soldering portion.

The second fixing bracket fixes the second terminals through insert molding, a first positioning portion protruding from the second fixing bracket in the direction towards the first fixing bracket, the first positioning portion extending along the arrangement direction of the second terminals and being perpendicular to the arrangement direction of the second terminals, and the first positioning portion corresponding to the first positioning hole of the first fixing bracket.

Therefore, the first fixing bracket and the second fixing bracket are inserted into each other through the insertion between the first positioning hole and the first positioning portion, and then are mounted in the insulating body, so as to complete the mounting of one electrical connector.

The first positioning hole of the first fixing bracket may further pass through the first fixing bracket, so that the first fixing portions of the first terminals are partially exposed in the first positioning hole. Furthermore, the second positioning portion on the second fixing bracket is further provided with a plurality of grooves corresponding to the first fixing portions of the first terminals, so that the first fixing portions of the first terminals are partially inserted into the grooves, so as to enhance a retention force between the first fixing bracket and the second fixing bracket.

In addition, a second positioning portion further protrudes from the first fixing bracket in the direction towards the second fixing bracket and a second positioning hole is further provided on the second fixing bracket at a position opposite to the second positioning portion, so that the second positioning portion is inserted into the second positioning hole, thereby enhancing the retention force between the first fixing bracket and the second fixing bracket.

Furthermore, in the present invention, the soldering portion of each first terminal is parallel to the arrangement direction of the first terminals. The soldering portion of each second terminal is perpendicular to the arrangement direction of the second terminals, and the soldering portions of the second terminals are arranged in two rows.

Additionally, a plurality of limit slots is further provided on the second fixing bracket on a side away from the second contact portions. Each limit slot is used for limiting the first soldering portion of each first terminal, so as to avoid the deformation of the first soldering portions of the first terminals.

BRIEF DESCRIPTION OF THE DRAWINGS

The present invention will become more fully understood from the detailed description given herein below for illustration only, and thus not limitative of the present invention, wherein.

DETAILED DESCRIPTION

To make the objectives, technical solutions, and advantages of the present invention clearer, the present invention is described in detail in the following specific embodiments in combination with the drawings.

Figure 1:
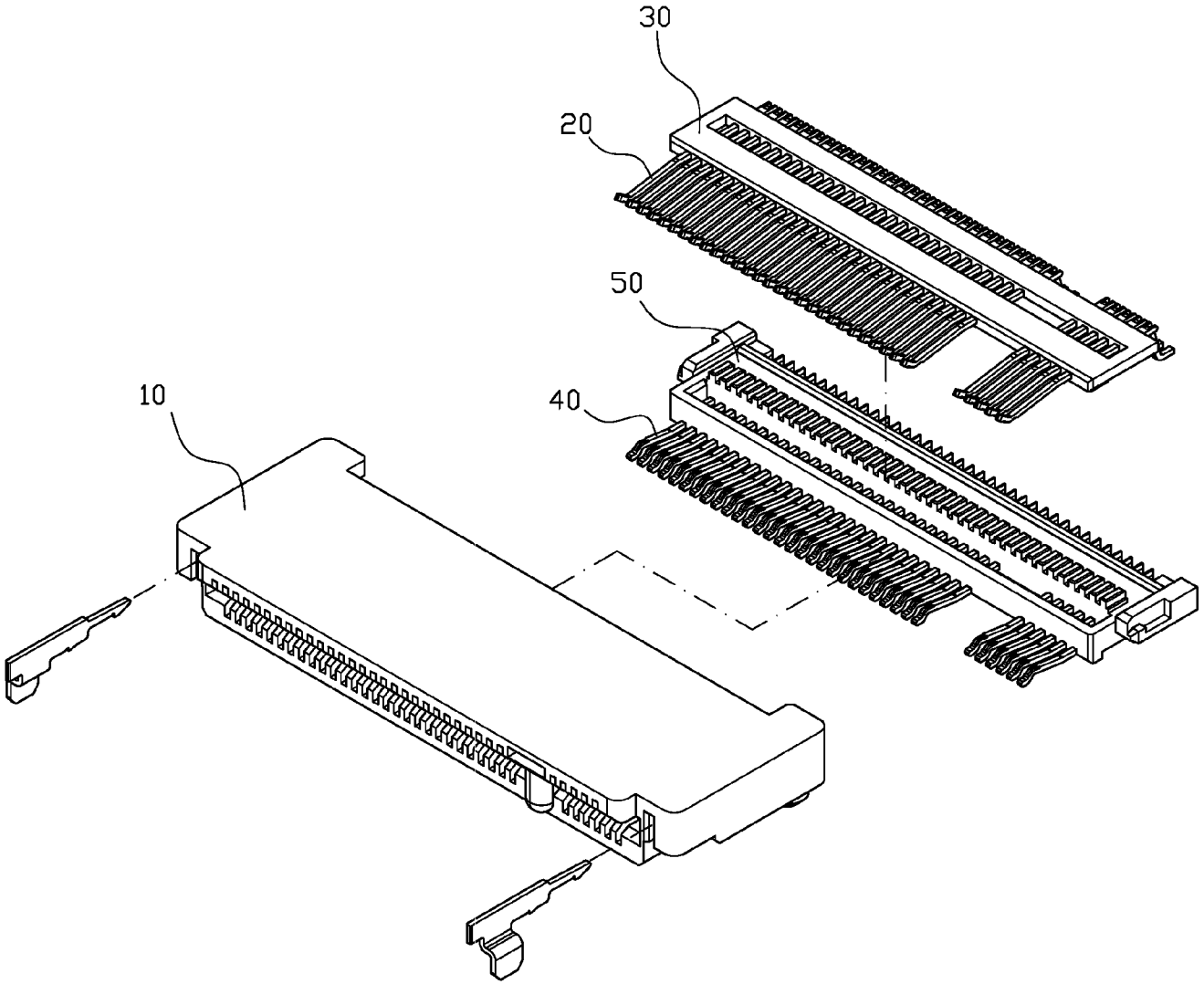
FIG. 1 is a three-dimensional exploded schematic view of a use status of the present invention.

As shown in FIG. 1, FIG. 1 is a three-dimensional exploded schematic view of a use status of the present invention. As shown in FIG. 1, the terminal module of the present invention is mainly provided in an electrical connector having an insulating body 10 and includes a plurality of first terminals 20, a first fixing bracket 30, a plurality of second terminals 40, and a second fixing bracket 50.

Figure 2:
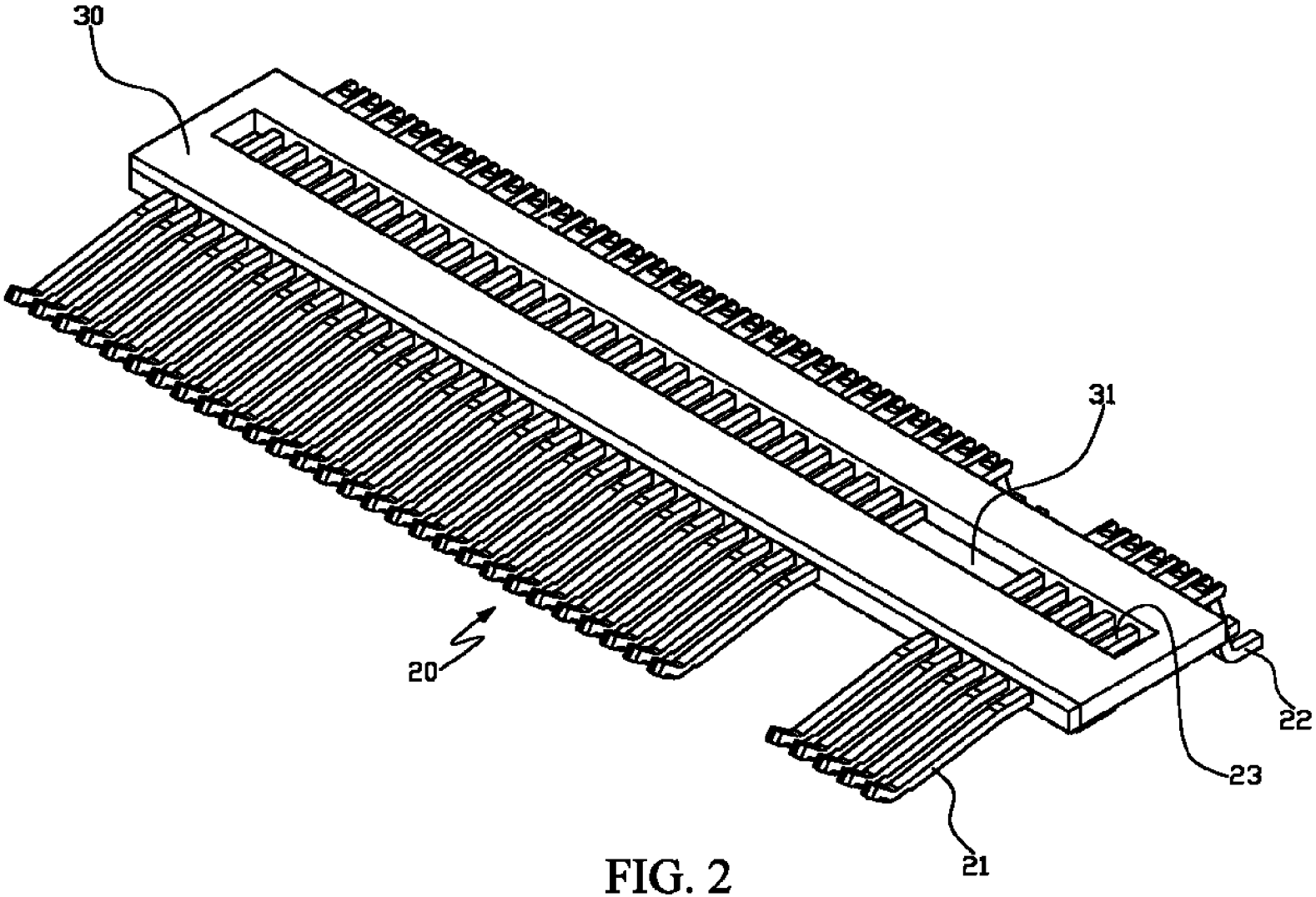
FIG. 2 is a three-dimensional schematic view of first terminals and a first fixing bracket being combined of the present invention.
Figure 3:
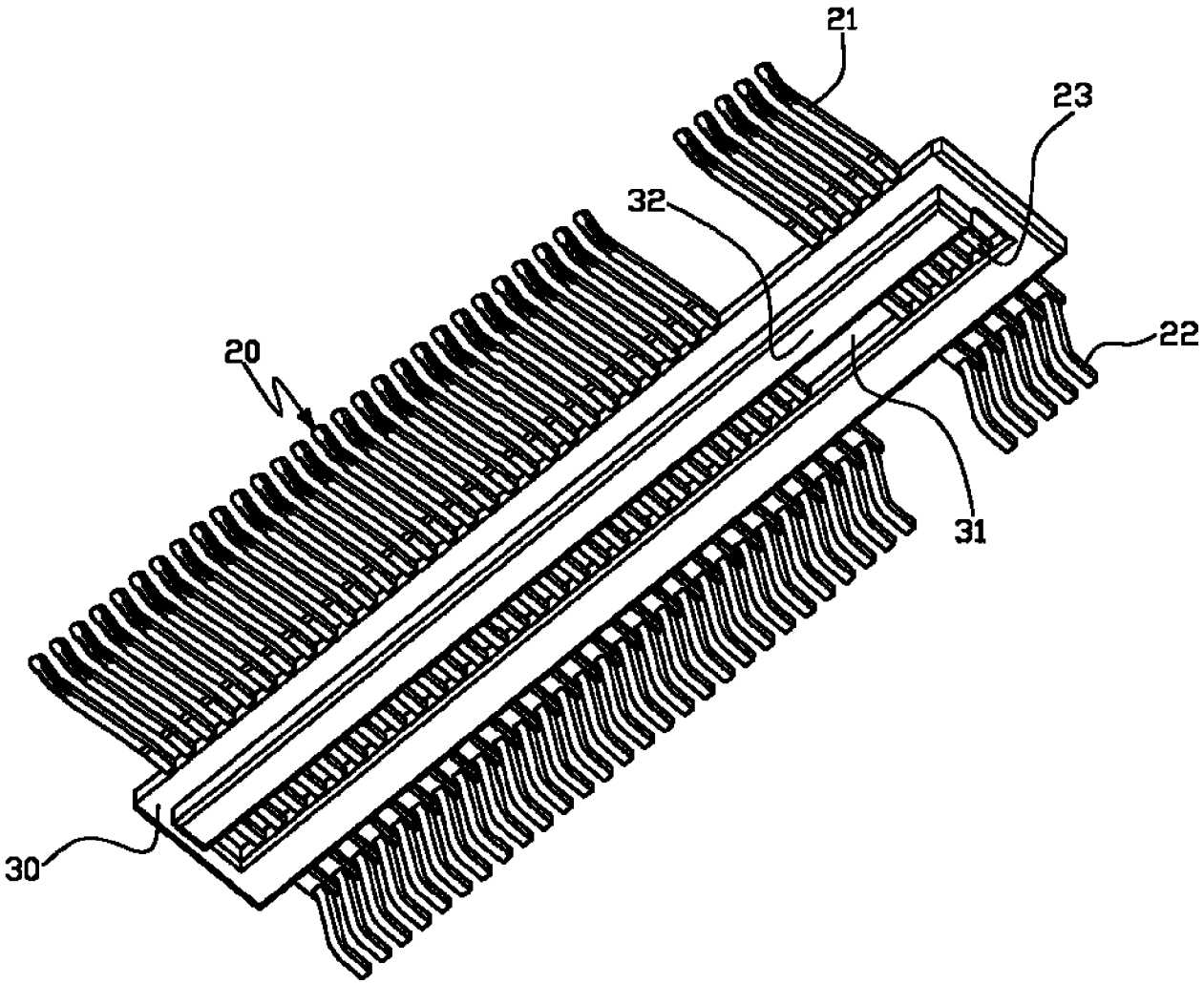
FIG. 3 is a three-dimensional view from another perspective of first terminals and a first fixing bracket being combined of the present invention.

Please refer to FIG. 2 and FIG. 3. FIG. 2 is a three-dimensional schematic view of the first terminals and the first fixing bracket being combined of the present invention and FIG. 3 is a three-dimensional view from another perspective of the first terminals and the first fixing bracket being combined of the present invention. As shown in FIG. 2 and FIG. 3, the plurality of first terminals 20 of the present invention is arranged along a direction. Each first terminal 20 includes a first contact portion 21, a first soldering portion 22, and a first fixing portion 23 for connecting the first contact portion 21 and the first soldering portion 22.

The first fixing bracket 30 fixes the first terminals 20 through insert molding. The first fixing bracket 30 mainly covers the first fixing portions 23 of the first terminals 20. Therefore, the first contact portions 21 and the first soldering portions 22 of the first terminals 20 extend outward from two corresponding sides of the first fixing bracket 30.

The first fixing bracket 30 is provided with a first positioning hole 31 which extends along the arrangement direction of the first terminals 20. The first positioning hole 31 passes through the first fixing bracket 30, so that the first fixing portions 23 of all the first terminals 20 are partially exposed in the first positioning hole 31.

In addition, a second positioning portion 32 further protrudes from the first fixing bracket 30 at a position close to an edge of the first positioning hole 31 and in the direction towards the second fixing bracket. The second positioning portion 32 is perpendicular to the arrangement direction of the first terminals 20.

Figure 4:
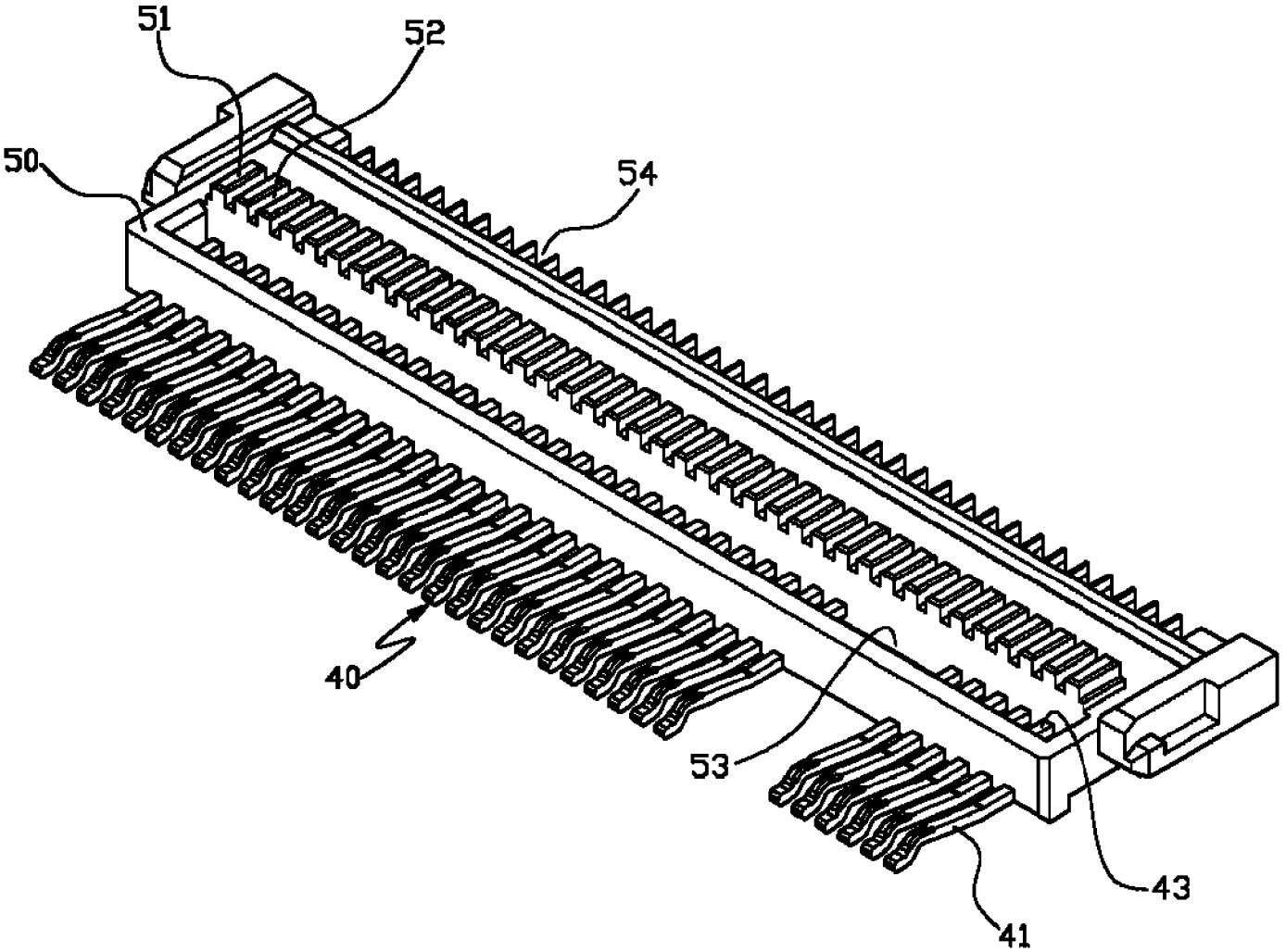
FIG. 4 is a three-dimensional schematic view of second terminals and a second fixing bracket being combined of the present invention.
Figure 5:
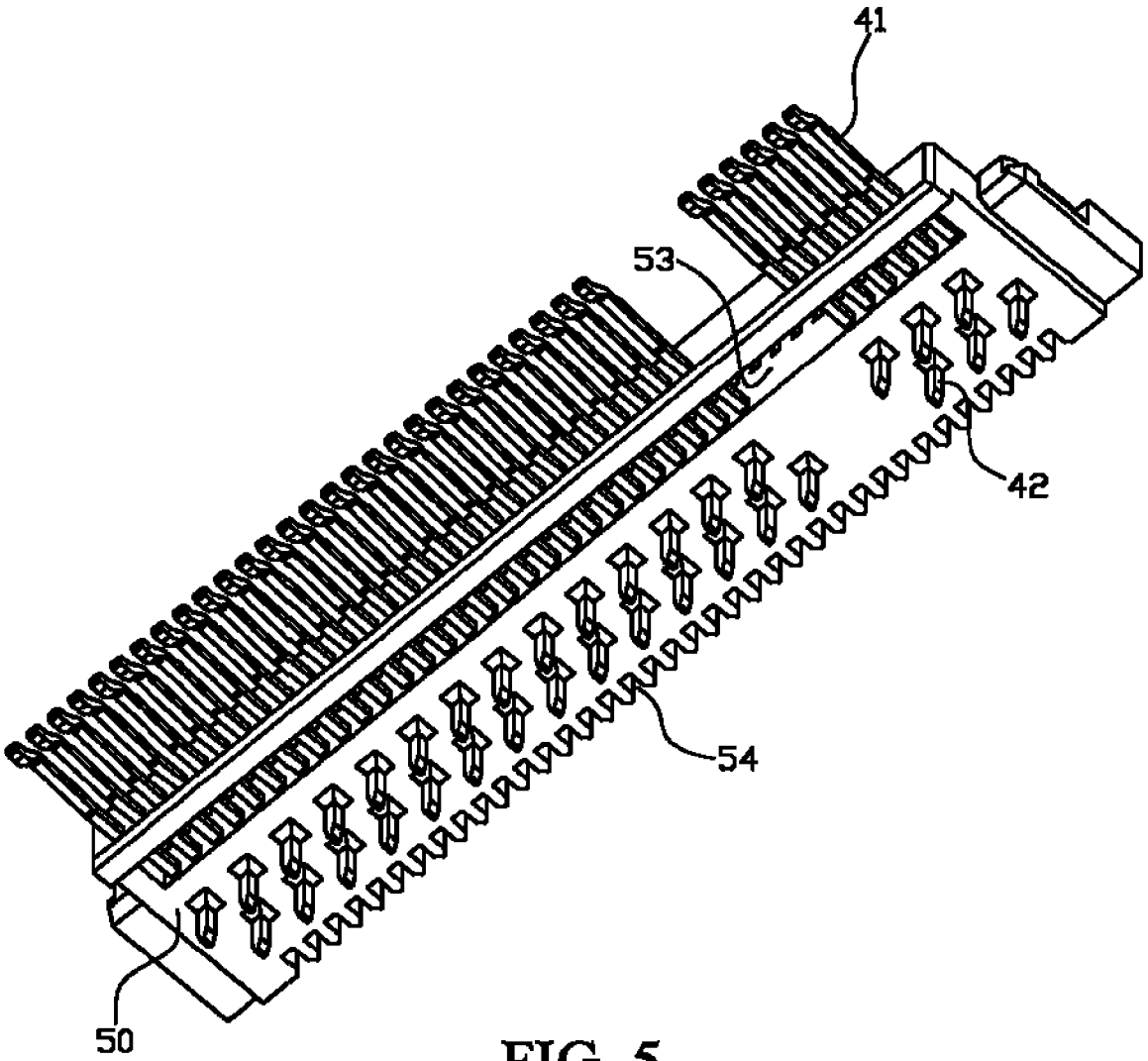
FIG. 5 is a plane schematic view of second terminals and a second fixing bracket being combined of the present invention.

Further, please refer to FIG. 4 and FIG. 5. FIG. 4 is a three-dimensional schematic view of the second terminals and the second fixing bracket being combined of the present invention and FIG. 5 is a plane schematic view of the second terminals and the second fixing bracket being combined of the present invention. As shown in FIG. 4 and FIG. 5, the second terminals 40 are arranged along the same direction with the first terminals, and the second terminals 40 and the first terminals are alternately arranged. Each second terminal 40 includes a second contact portion 41, a second soldering portion 42, and a second fixing portion 43 for connecting the second contact portion 41 and the second soldering portion 42.

The second fixing bracket 50 fixes the second terminals 40 through insert molding. The second fixing bracket 50 covers the second fixing portions 43 of the second terminals 40, so that the second contact portions 41 of the second terminals 40 extend outward from one side of the second fixing brackets 50 same as the side of the first contact portions of the first terminals.

A first positioning portion 51 protrudes from the second fixing bracket 50 at a position opposite to the first positioning hole of the first fixing bracket and in the direction towards the first fixing bracket, so that the first positioning portion 51 is inserted into the first positioning hole. Furthermore, the first positioning portion 51 is further provided with a plurality of grooves 52. Each groove 52 corresponds to one first fixing portion exposed in the first positioning hole, so that each first fixing portion exposed in the first positioning hole is inserted into each groove 52.

In addition, the second fixing bracket 50 is further provided with a second positioning hole 53 at a position close to a side edge of the first positioning portion 51. The second positioning hole 53 passes through the second fixing bracket 50, so that the second fixing portions 43 of the second terminals 40 are partially exposed in the second positioning hole 53. Furthermore, the second positioning hole 53 corresponds to the second positioning portion of the first fixing bracket, so that the second positioning portion is inserted into the second positioning hole 53.

Furthermore, a plurality of limit slots 54 protrudes from the second fixing bracket 50 on a side away from the second contact portions 41 of the second terminals 40. Each limit slot 54 corresponds to the first soldering portion of each first terminal and is used for receiving the first soldering portion of each first terminal.

Figure 6:
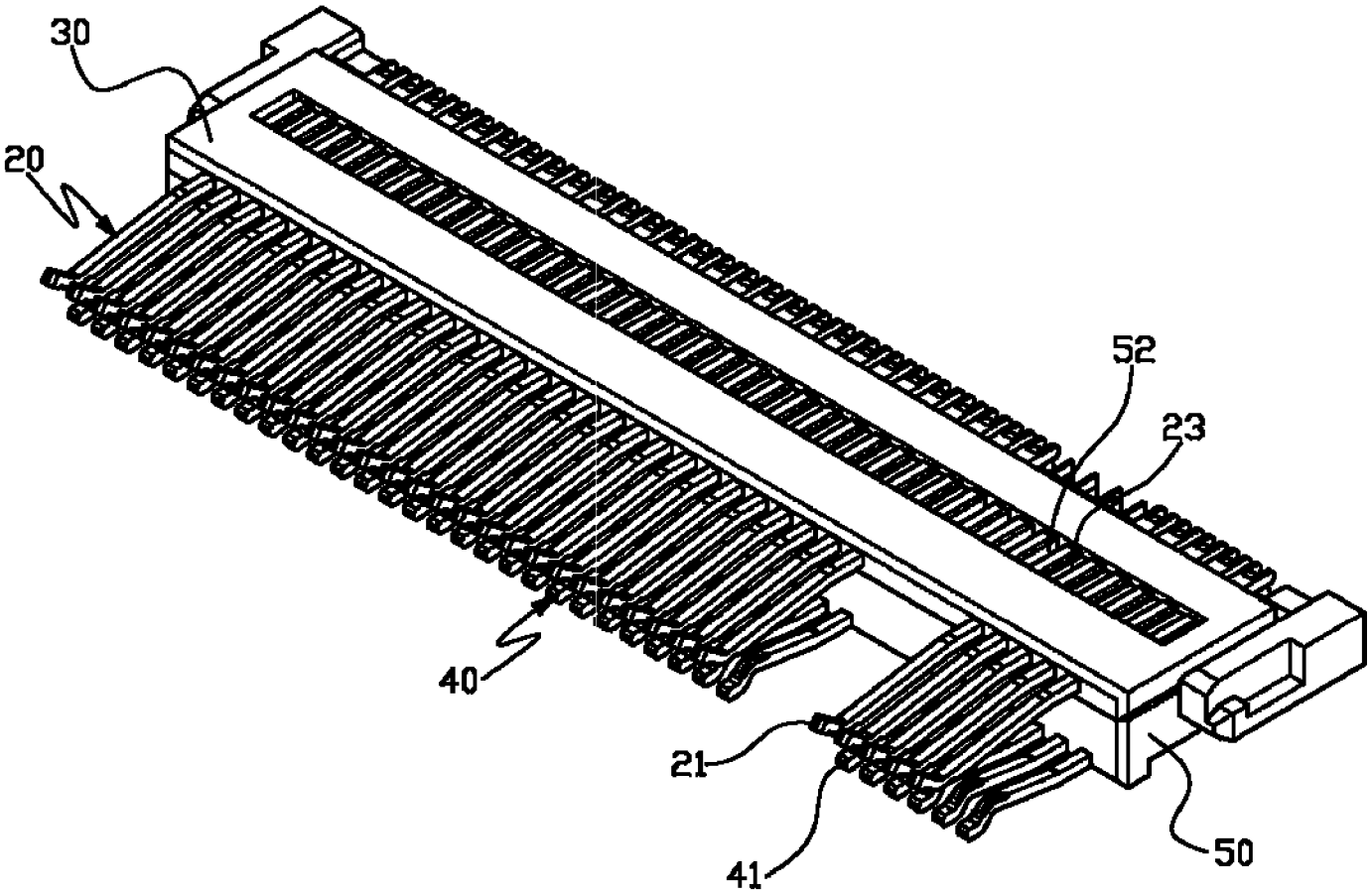
FIG. 6 is a three-dimensional schematic view of an assembled terminal module of the present invention.
Figure 7:
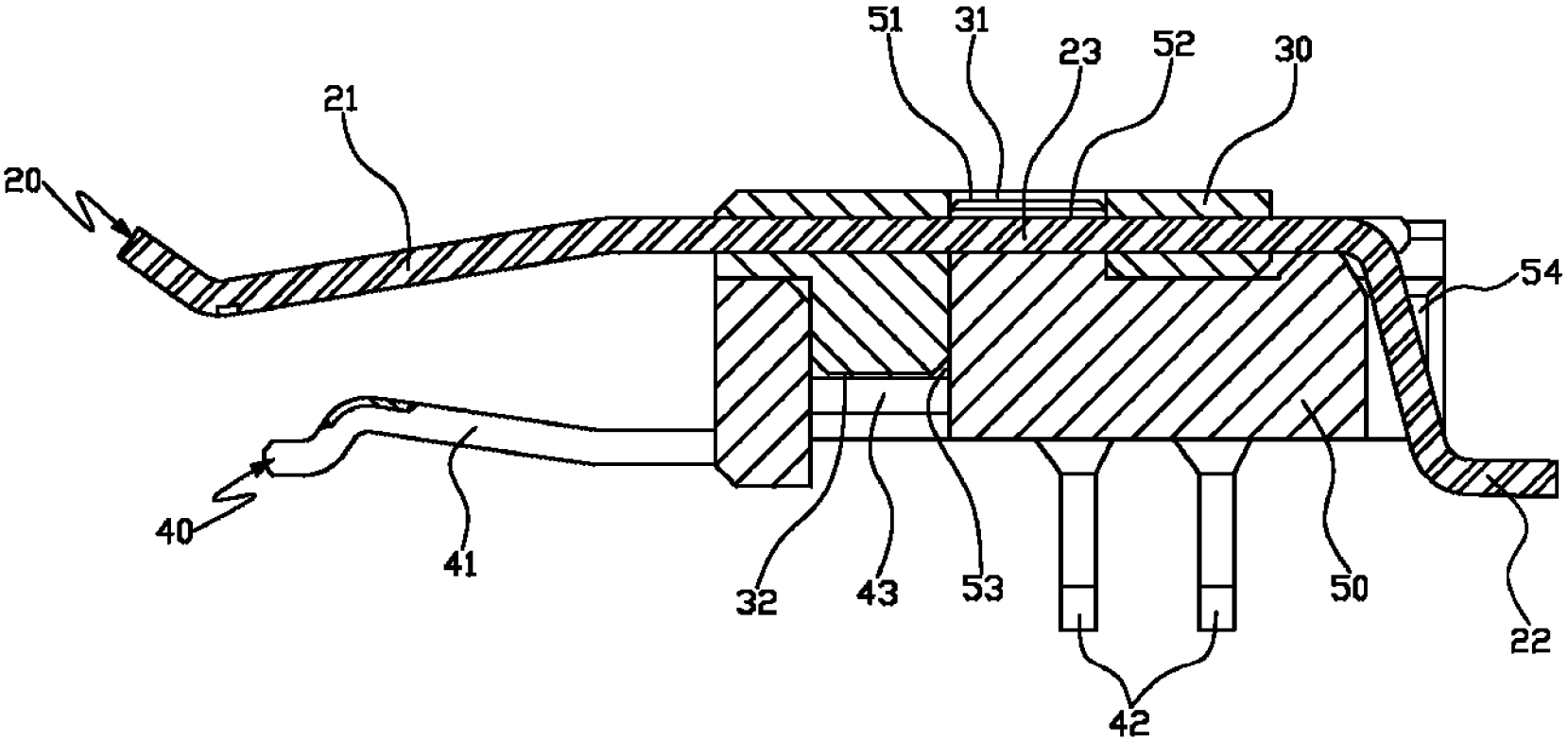
FIG. 7 is a schematic sectional view of an assembled terminal module of the present invention.

Please refer to FIG. 6 and FIG. 7. FIG. 6 is a three-dimensional schematic view of an assembled terminal module of the present invention and FIG. 7 is a schematic sectional view of an assembled terminal module of the present invention. As shown in FIG. 6 and FIG. 7, when the terminal module of the present invention is assembled, the first fixing bracket 30 and the second fixing bracket 50 are inserted into each other. The first positioning portion 51 on the second fixing bracket 50 is inserted into the first positioning hole 31 of the first fixing bracket 30, so that each first fixing portion 23 of the first terminal 20 exposed in the first positioning hole 31 is inserted into each groove 52.

Consequently, a retention force between the first fixing bracket 30 and the second fixing bracket 50 can be enhanced. The first fixing bracket 30 and the second fixing bracket 50 are inserted into each other. Further, the first contact portions 21 of the first terminals 20 and the second contact portions 41 of the second terminals 40 are alternately arranged in two rows. That is, the second contact portion 41 of each second terminal 40 is positioned between the first contact portions 21 of two first terminals 20. Oppositely, the first contact portion 21 of each first terminal 20 is positioned between the second contact portions 41 of two second terminals 40.

Furthermore, the first fixing bracket 30 and the second fixing bracket 50 may be further inserted into each other through the second positioning portion 32 and the second positioning hole 53, in addition to the insertion of the first positioning portion 51 into the first positioning hole 31, so as to achieve a secondary insertion effect. In this way, the first fixing bracket 30 and the second fixing bracket 50 are effectively prevented from falling off. Further, a retention force of the insertion between the first fixing bracket 30 and the second fixing bracket 50 is enhanced.

In addition, in this embodiment, the first soldering portions 22 of the first terminals 20 are generally arranged parallel to the arrangement direction of the first terminals 20. Furthermore, the first soldering portions 22 of the first terminals 20 are limited through the limit slots 54 of the second fixing bracket 50. Therefore, an offset or deformation phenomenon of the first soldering portions 22 can be avoided.

Additionally, the second soldering portions 42 of the second terminals 40 are arranged perpendicular to the arrangement direction of the second terminals 40. In this embodiment, the second soldering portions 42 are arranged in two rows. The second soldering portions 42 may certainly also be arranged in one row or three rows. In this embodiment, the two-row arrangement is a main implementation aspect.

Finally, in combination with FIG. 1, after the first fixing bracket 30 and the second fixing bracket 50 are inserted into each other, the terminal module of the present invention may be disposed inside the insulating body 10. In the present invention, for the first fixing bracket 30 and the second fixing bracket 50, the plurality of first terminals 20 and the plurality of second terminals 40 are fixed through insert molding respectively. Next, the first fixing bracket 30 and the second fixing bracket 50 are stacked in terms of thickness to effectively reduce the height of the first fixing bracket 30 and the second fixing bracket 50. Therefore, the height of the insulating body 10 is reduced effectively as the height of the first fixing bracket and the second fixing bracket is reduced. In this manner, the height of the entire electrical connector is also reduced effectively, so as to further meet the requirement of a thin electrical connector.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A terminal module, applied in an electrical connector having an insulating body, and comprising:

a plurality of first terminals, arranged along a direction, each first terminal comprising a first contact portion, a first soldering portion, and a first fixing portion for connecting the first contact portion and the first soldering portion;

a first fixing bracket, covering the first fixing portion of each first terminal, the first fixing bracket being provided with at least one first positioning hole along the arrangement direction of the plurality of first terminals;

a plurality of second terminals, arranged parallel to the first terminals and along the same direction thereof, each second terminal comprising a second contact portion, a second soldering portion, and a second fixing portion for connecting the second contact portion and the second soldering portion; and a second fixing bracket, covering the second fixing portion of each second terminal, a first positioning portion protruding from the second fixing bracket in the direction towards the first fixing bracket, the first positioning portion extending along the arrangement direction of the second terminals and being perpendicular to the arrangement direction of the second terminals, and the first positioning portion being inserted into the first positioning hole of the first fixing bracket, wherein a plurality of limit slots protrudes from the second fixing bracket on a side away from the second contact portions of the second terminals, and each limit slot receives soldering portions of the first terminals.

2. The terminal module according to claim 1, wherein a second positioning portion further protrudes from the first fixing bracket in the direction towards the second fixing bracket, a second positioning hole is further provided on the second fixing bracket at a position opposite to the second positioning portion, so that the second positioning portion is inserted into the second positioning hole.

3. The terminal module according to claim 1, wherein the first positioning hole passes through the first fixing bracket, so that the first fixing portions of all the first terminals are partially exposed in the first positioning hole.

4. The terminal module according to claim 3, wherein the first positioning portion of the second fixing bracket is further provided with a plurality of grooves, and each groove corresponds to the first fixing portions exposed in the first positioning hole, so that the first fixing portions exposed in the first positioning hole are inserted into all grooves.

5. The terminal module according to claim 1, wherein the first soldering portions of the first terminals are parallel to the arrangement direction of the first terminals and the second soldering portions of the second terminals are perpendicular to the arrangement direction of the second terminals.

6. The terminal module according to claim 5, wherein the second soldering portions of the second terminals are arranged in two rows.

7. A terminal module, applied in an electrical connector having an insulating body, and comprising:

a plurality of first terminals, arranged along a direction, each first terminal comprising a first contact portion, a first soldering portion, and a first fixing portion for connecting the first contact portion and the first soldering portion;

a first fixing bracket, covering the first fixing portion of each first terminal, the first fixing bracket being provided with at least one first positioning hole along the arrangement direction of the plurality of first terminals;

a plurality of second terminals, arranged parallel to the first terminals and along the same direction thereof, each second terminal comprising a second contact portion, a second soldering portion, and a second fixing portion for connecting the second contact portion and the second soldering portion; and a second fixing bracket, covering the second fixing portion of each second terminal, a first positioning portion protruding from the second fixing bracket in the direction towards the first fixing bracket, the first positioning portion extending along the arrangement direction of the second terminals and being perpendicular to the arrangement direction of the second terminals, and the first positioning portion being inserted into the first positioning hole of the first fixing bracket;

wherein the first positioning hole passes through the first fixing bracket, so that the first fixing portions of all the first terminals are partially exposed in the first positioning hole; the first positioning portion of the second fixing bracket is further provided with a plurality of grooves, and each groove corresponds to the first fixing portions exposed in the first positioning hole, so that the first fixing portions exposed in the first positioning hole are inserted into all grooves.

8. The terminal module according to claim 7, wherein a second positioning portion further protrudes from the first fixing bracket in the direction towards the second fixing bracket, a second positioning hole is further provided on the second fixing bracket at a position opposite to the second positioning portion, so that the second positioning portion is inserted into the second positioning hole.

9. The terminal module according to claim 7, wherein the first soldering portions of the first terminals are parallel to the arrangement direction of the first terminals and the second soldering portions of the second terminals are perpendicular to the arrangement direction of the second terminals.

10. The terminal module according to claim 9, wherein the second soldering portions of the second terminals are arranged in two rows.

* * * * *